US005191976A

United States Patent [19]

Stout et al.

[11] Patent Number: 5,191,976

[45] Date of Patent: Mar. 9, 1993

[54] BASKET CARRIER WITH WEBBED REINFORCED BOTTOM

[75] Inventors: James T. Stout, Acworth; James B. DeMaio, Marietta, both of Ga.

[73] Assignee: The Mead Corporation, Dayton, Ohio

[21] Appl. No.: 801,884

[22] Filed: Dec. 3, 1991

[51] Int. Cl.[5] ..... B65D 71/00

[52] U.S. Cl. ..... 206/198; 206/162; 229/120.11

[58] Field of Search ..... 206/139, 162, 170, 180, 206/186, 187, 192, 193, 198, 427, 431, 433; 229/120.08, 120.11, 120.18

[56] References Cited

U.S. PATENT DOCUMENTS

| | | | |
|---|---|---|---|
| 2,800,250 | 7/1957 | Buttery | 206/180 |
| 2,942,756 | 6/1960 | Collura et al. | 229/120.18 |
| 4,047,610 | 9/1977 | Stout et al. | 206/198 |
| 4,312,446 | 1/1982 | Summers | 206/198 |
| 4,792,038 | 12/1988 | Cooper | 206/427 |
| 4,798,285 | 1/1989 | Hernandez | 206/427 |

*Primary Examiner*—Jimmy G. Foster
*Attorney, Agent, or Firm*—Rodgers & Rodgers

[57] ABSTRACT

The bottom structure of a heavy duty basket style article carrier is reinforced by an anchoring panel foldably joined to a side edge of bottom panels on each side of the carrier and is foldably joined to a first web panel to which a second web panel is foldably joined, each anchoring panel being secured to the associated bottom panel and the two web panels being collapsible along a common fold line when the carrier is collapsed and an attachment flap is foldably joined to the second web panel on each side of the carrier and is yieldably joined to the lower part of the adjacent end wall panel to form a yieldable lower bottom portion of the associated end wall panel thereby to facilitate locking the carrier in set up condition.

6 Claims, 3 Drawing Sheets

BASKET CARRIER WITH WEBBED REINFORCED BOTTOM

TECHNICAL FIELD

This invention relates to article carriers commonly used to transport articles such as primary packages.

BACKGROUND ART

U.S. Pat. No. 4,047,610 issued Sep. 13, 1977 and owned by the assignee of this invention discloses and claims an article carrier of the general type to which this invention pertains.

SUMMARY OF THE INVENTION

According to this invention in one form, a heavy duty article carrier of the basket style is provided and includes anchoring panels foldably joined to corresponding side edges of the two bottom panels on opposite sides of the medial partition of the carrier, a first web panel foldably joined to each of the anchoring panels together with a second web panel foldably joined to each of the first panels together with an attachment flap foldably joined to each of the second web panels along one edge of each of said second web panels and each attachment flap being yieldably joined to the lower part of the adjacent one of the end wall panels and forming a lower bottom portion of the associated end wall panel, each attachment flap being inwardly inclined and arranged to accommodate yieldable engagement with a notched hook on the medial partition of the carrier with a notch on an adjacent edge of the reinforced composite bottom panel and slits defining one edge of each attachment flap to allow the notched hook to pass therebetween.

BEST MODE OF CARRYING OUT THE INVENTION

Figure 1:
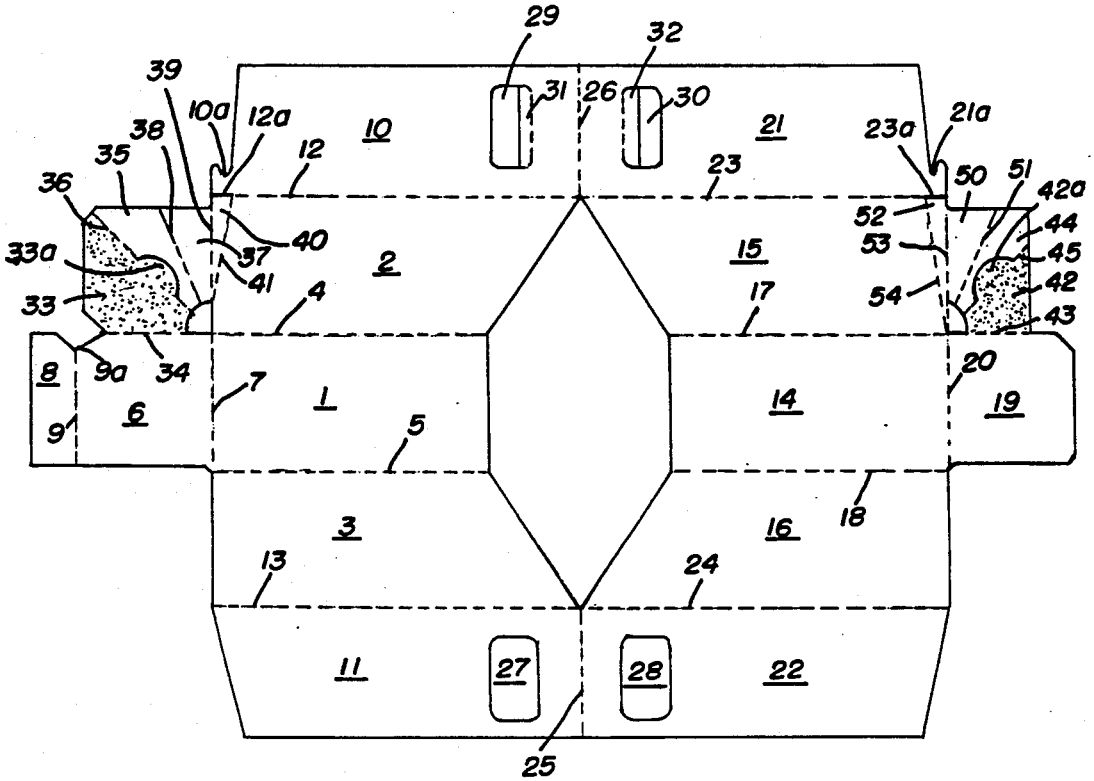
FIG. 1 is a plan view from the inside of the blank formed according to this invention and which is manipulated through the steps represented in FIGS. 2, 3, 4 and 5 to form the complete collapsed carrier as shown in FIG. 5.

The blank as shown in FIG. 1 includes a side wall 1 which is foldably joined to end wall panels 2 and 3 along fold lines 4 and 5 respectively. A bottom panel 6 is foldably joined to side wall 1 along fold line 7 and a glue flap 8 is foldably joined to bottom panel 6 along fold line 9. A riser panel 10 is foldably joined to end panel 2 along fold line 12 and riser panel 11 is foldably joined to end wall panel 3 along fold line 13.

The other side of the blank is similar and includes side wall 14 to which end panels 15 and 16 are foldably joined along fold lines 17 and 18 respectively. A riser panel 21 is foldably joined to end panel 15 along fold line 23 and riser panel 22 is foldably joined to end panel 16 along fold line 24. Riser panels 11 and 22 are foldably joined along their top edges at fold line 25 and riser panels 10 and 21 are foldably joined along their top edges at fold line 26.

A hand gripping aperture 27 is formed in riser panel 11 and a hand gripping aperture 28 is formed in riser panel 22. In like fashion, a hand gripping aperture 29 is formed in riser panel 10 and a similar handle gripping aperture 30 is formed in riser panel 21. A cushioning flap 31 is associated with aperture 29 and cushioning flap 32 is associated with hand gripping aperture 30 in a manner well known in the art.

The strengthening structure formed according to this invention includes a collapsible interconnection between bottom panel 6 and end wall panel 2 and includes anchoring panel 33 which is foldably joined to bottom panel 6 along fold line 34 together with a first web panel 35 joined to anchoring panel 33 along interrupted fold line 36 and a second web panel 37 foldably joined to first web panel 35 along a fold line 38. An attachment flap 40 is foldably joined to second web panel 37 along fold line 39 and to end wall 2 along fold line 41. Cut line **12*a* is aligned with fold line 12. A reinforcing tab 33*a* forms an integral projection of anchoring panel 33 and is struck from the first web panel 35. As is obvious particularly from FIG. 1 attachment flap 40** is of triangular configuration.

The reinforcing structure at the other side of the blank includes anchoring panel 42 foldably joined to bottom panel 19 along fold line 43 together with first web panel 44 foldably joined to anchoring panel 42 along interrupted fold line 45 together with a second web panel 50 foldably joined to first web panel 44 along fold line 51. A triangular attachment flap 52 is foldably joined along fold line 53 to an edge of second web panel 50 and is foldably joined to end wall 15 along fold line 54. Cut line **23*a* is aligned with fold line 23. A reinforcing tab 42*a* forms an integral projection of anchoring panel 42 and is struck from the first web panel 44**.

Figure 2:
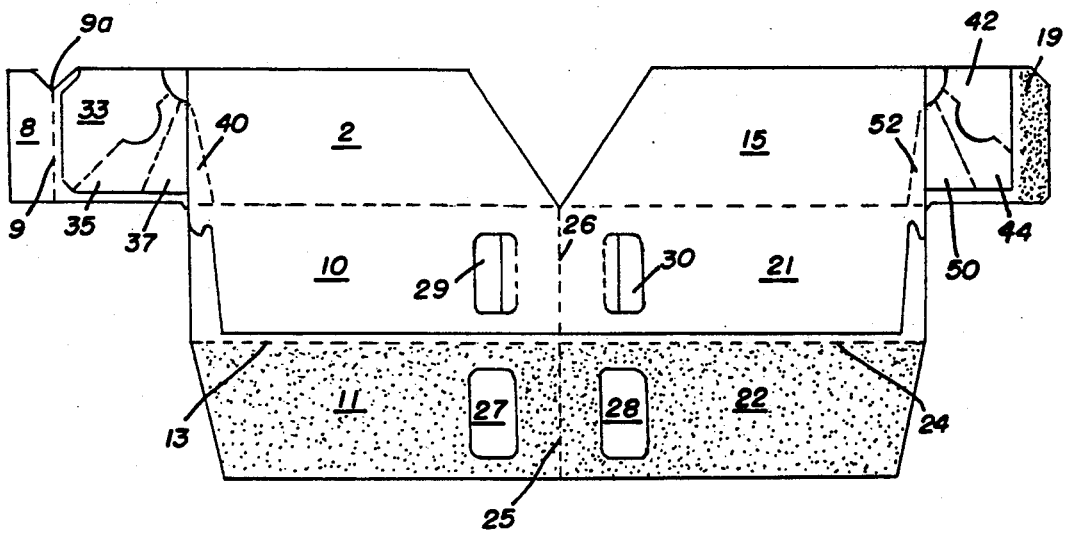

In order to manipulate the blank of FIG. 1 into a completed carrier, an application of glue is made to anchoring panels 33 and 42 and to reinforcing tabs **33*a* and 42*a* as shown by stippling in FIG. 1. Thereafter end panels 2 and 15 together with riser panels 10 and 21 and the reinforcement structure associated with panels 2 and 15 are all elevated and folded along fold lines 34, 4, 17 and 43. After this folding operation the blank appears as shown in FIG. 2. This operation causes anchoring panel 33 and reinforcing tab 33*a* to become adhered to bottom panel 6 and also causes anchoring panel 42 and reinforcing tab 42*a* to become adhered to bottom panel 19. This relationship of parts insure that anchoring panels 33 and 43 and reinforcing tabs 33*a* and 42*a* are rigidly secured to bottom panel 6 and 19**.

An application of glue is then made to riser panels 11 and 22 as indicated by stippling in FIG. 2. Thereafter riser panels 11 and 22 are elevated and folded into contact with riser panels 10 and 21 the fold being along fold lines 13 and 24 and the blank then appears as shown in FIG. 3.

Figure 3:
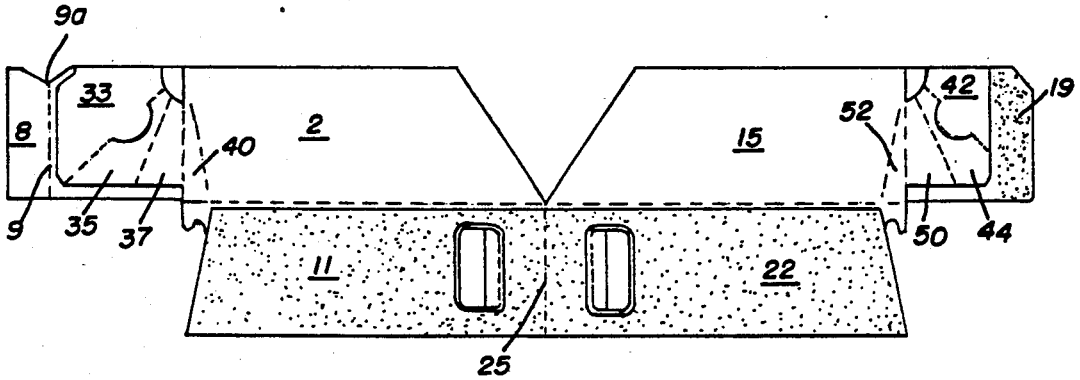
Figure 4:
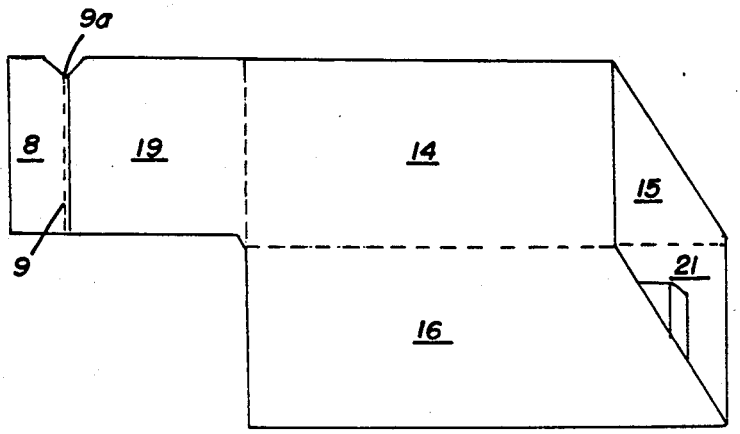

An application of glue is then made to riser panels 11 and 22 as indicated by stippling in FIG. 3 and to an edge of bottom panel 19 as indicated by stippling in FIG. 2. Riser panel 22 and side wall 15 and associated structure are folded upwardly and to the left along fold line 25 and the blank then appears as shown in FIG. 4. Of course this operation secures the riser panels 11 and 22 together in face contacting relation.

Figure 5:
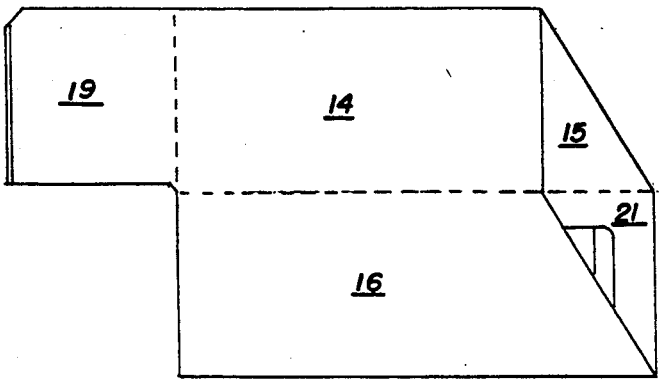

Glue flap 8 is folded to the right along fold line 9 to cause the glue flap 8 to become adhered to an edge of bottom wall panel 19 and the carrier then appears in complete collapsed form as shown in FIG. 5.

Figure 6:
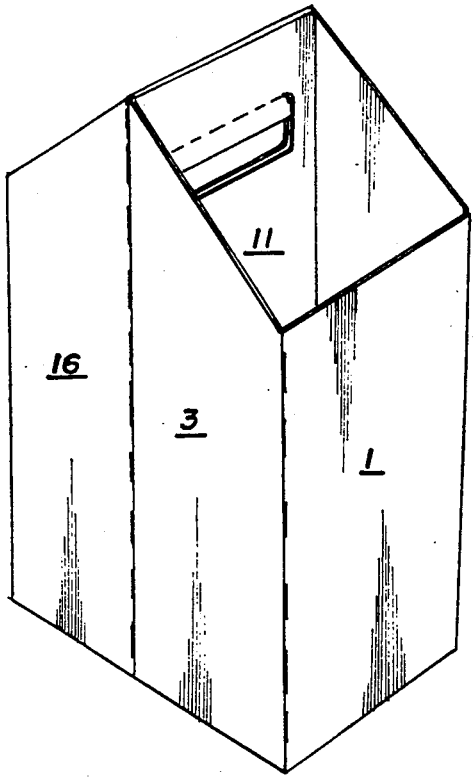
FIG. 6 is a perspective view of the carton of FIG. 5 when set up and ready for loading.
Figure 7:
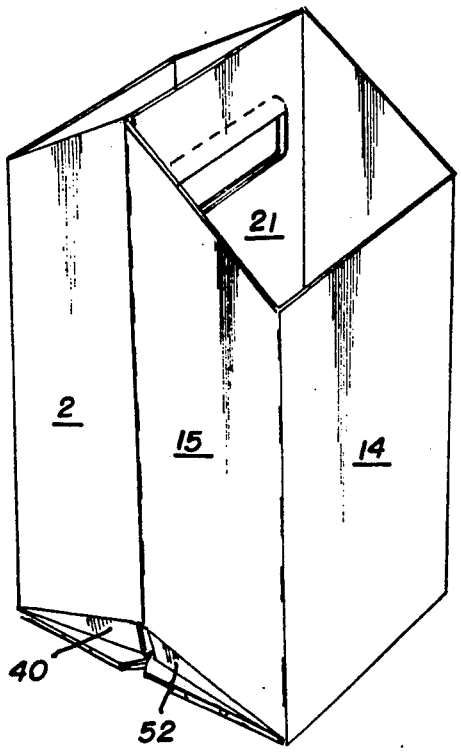
FIG. 7 is a view similar to FIG. 6 but with parts cutaway to facilitate an understanding of the disposition of the various parts.

When set up and ready for loading the carrier appears as shown in FIG. 6. FIG. 7 simply shows areas broken away so as to afford a view of the inside of the bottom of the carrier.

When fully assembled and set up, the notches 10*a* and 21*a* coincide with each other in flat face contacting relation and engage the notch 9*a* to aid in maintaining a stable set up condition for the carrier.

In order to set the carrier up from the collapsed condition shown in FIG. 5 and as is well known external forces are applied t the complete collapsed carrier so as to force the parts to occupy the position depicted in FIG. 6. Toward this end, the attachment flaps such as 40 and 52 yield by folding inwardly along fold lines 41 and 54 in order to accommodate an easy interlocking action between the locking hooks 10*a*, 21*a* which are in engagement with the notch 9*a*. The slits 12*a* and 23*a* allow the notched hook 10*a*, 21*a* to pass therebetween.

During a set up operation, the web panels 35 and 37 are folded upwardly along fold lines 38 and 51 and the attachment flaps are folded inwardly into the bevelled arrangement shown in FIG. 7 and thus allow the hooks 10*a*, 21*a* to move into engagement with the notch 9*a*. The fixed relationship between anchoring panels 33 and 42 and their associated reinforcing tabs 33*a* and 42*a* insures that fold lines 36 and 45 are fixed in relation to the bottom panels 6 and 19. After engagement of the hooks 10*a*, 21*a* with notch 9*a*, the hooks 10*a*, 21*a* and the end wall panels 2 and 15 move inwardly and the attachment flaps may retain the bevelled positions shown in FIG. 7. Loading of bottles forces the web panels 35, 37 and 44 and 50 into coplanar relation and the attachment flaps assume coplanar positions with the end wall panels 2 and 15. The coplanar positions of web panels 35, 37, 44 and 50 greatly reinforces and strengthens the bottom wall.

Basket style article carriers for packaging two large bottles are subjected to high stress when a purchaser simply removes one bottle and leaves the other bottle in the carrier. By this invention the carrier is provided with a rigid mechanically strong bottom structure which includes the coplanar web panels 35, 37 and 44, 50 to prevent failure of the carrier when only one bottle is left in the carrier. Also by use of the novel attachment flap the carrier is arranged to facilitate set up operations.

We claim:

1. An article carrier comprising opposed side walls, end wall panels foldably joined to the end edges of said side walls and extending inwardly therefrom, riser panels foldably joined to said end wall panels remote from said side walls and extending medially inward of the carrier and having upwardly extending portions, a multiple ply handle formed in the upwardly extending portions of said riser panels, a bottom panel foldably joined to the lower edge of each one of said side walls, an anchoring panel foldably joined to a side edge of each of said bottom panels and secured in flat face containing relation therewith, a first web panel foldably joined to each of said anchoring panels along a diagonal edge of each of such anchoring panels which edge is angularly disposed relative to said side edge of the associated bottom panel, a second web panel foldably joined to each of said first web panels along a diagonal fold line which is angularly disposed to said diagonal edge, and an attachment flap foldably joined to each of said second web panels along one edge of each of said second web panels wherein said one edge is generally coaxial with an side wall lower edge and each attachment flap being also foldably joined to the lower part of an adjacent one of said end wall panels along a fold line which is angularly disposed relative to said fold line between said second web panels and said attachment flap and forming a lower bottom portion of the associated end wall panel.

2. An article carrier according to claim 1 wherein each of said attachment flaps is of triangular configuration and wherein said attachment flaps are inwardly inclined after the carrier is set up and before loading takes place.

3. An article carrier comprising opposed side walls, end wall panels foldably joined to the end edges of said side walls and extending inwardly therefrom, riser panels foldably joined to said end wall panels remote from said side walls and extending medially inward of the carrier and having upwardly extending portions, a multiple ply handle formed in the upwardly extending portions of said riser panels, a bottom panel foldably joined to the lower edge of each one of said side walls, an anchoring panel foldably joined to a side edge of each of said bottom panels and secured in flat face contacting relation therewith, a reinforcing tab formed integrally with each of said anchoring panels and secured in flat face contacting relation with the associated bottom panel and wherein each of said reinforcing tabs is disposed between and spaced from the ends of said diagonal edge of the associated anchoring panel, a first web panel foldably joined to each of said anchoring panels along a diagonal edge of each of such anchoring panels which edge is angularly disposed relative to said side edge of the associated bottom panel, a second web panel foldably joined to each of said first web panels along a diagonal fold line which is angularly disposed to said diagonal edge, and an attachment flap foldably joined to each of said second web panels along one edge of each of said second web panels and each attachment flap being foldably joined to the lower part of the adjacent one of said end wall panels and forming a lower bottom portion of the associated end wall panel.

4. An article carrier comprising opposed side walls, end wall panels foldably joined to the end edges of said side walls and extending inwardly therefrom, riser panels foldably joined to said end wall panels remote from said side walls and extending medially inward of the carrier and having upwardly extending portions, a multiple ply handle formed in the upwardly extending portions of said riser panels, a bottom panel foldably joined to the lower edge of each one of said side walls, an anchoring panel foldably joined to a side edge of each of said bottom panels and secured in flat face contacting relation therewith, a first web panel foldably joined to each of said anchoring panels along a diagonal edge of each of such anchoring panels which edge is angularly disposed relative to said side edge of the associated bottom panel, a second web panel foldably joined to each of said first web panels along a diagonal fold line which is angularly disposed to said diagonal edge, and an attachment flap foldably joined to each of said second web panels along one edge of each of said second web panels and each attachment flap being foldably joined to the lower part of the adjacent one of said end wall panels and forming a lower bottom portion of the associated end wall panel, medial adjacent edges of said attachment flaps being defined by flits and wherein a two-ply notched hook is disposed between said slits.

5. An article carrier blank comprising a first pair of riser panels foldably joined to each other along their upper edges, a first pair of end wall panels foldably joined along their inner end edges respectively to first edges of said riser panels, a pair of side walls foldably joined along first side edges thereof to the outer edges respectively of said first pair of end wall panels, a second pair of end wall panels foldably joined along their outer edges respectively to second side edges of said side walls respectively, a second pair of riser panels foldably joined along second edges thereof to the inner edges of said second pair of end wall panels respectively and foldably joined to each other along their top edges, a pair of bottom panels foldably joined respectively to the bottom edges of said side wall panels respectively, a pair of anchoring panels foldably joined respectively to corresponding side edges of said bottom panels, a first pair of web panels foldably joined respectively to said anchoring panels along diagonal fold lines which are angularly disposed relative to said side edges of the associated bottom panel, a second pair of web panels foldably joined to said first pair of web panels respectively, and a pair of attachment flaps foldably joined respectively to said second pair of web panels and to the adjacent, lower part of said second pair of end walls respectively, and a slit which separates a corner of each of said riser panels from an edge of each of said attachment flaps.

6. An article carrier according to claim 5 wherein a notched hook is formed on each of said riser panels in close proximity to one of said slits.

* * * * *